US006101722A

United States Patent [19]

Cheng

[11] Patent Number: 6,101,722

[45] Date of Patent: Aug. 15, 2000

[54] RETRACTABLE KNIFE WITH SINGLE-EDGED BLADE

[76] Inventor: Yang-Fu Cheng, 6F, No. 100, Chung Hsiao E. Rd., Sec. 2, Taipei, Taiwan

[21] Appl. No.: 09/392,143

[22] Filed: Sep. 9, 1999

[51] Int. Cl.[7] ..... B26B 1/02

[52] U.S. Cl. ..... 30/155; 30/161

[58] Field of Search ..... 30/155, 157, 160, 30/161

[56] References Cited

U.S. PATENT DOCUMENTS 5,060,379 10/1991 Neely ..... 30/161

5,621,973 4/1997 Seber et al. ..... 30/161

OTHER PUBLICATIONS

"K.I.S.S." knife from "Columbia River Knife & Tool" catalog, Jan. 1998.

*Primary Examiner*—Hwei-Siu Payer

*Attorney, Agent, or Firm*—Bacon & Thomas

[57] ABSTRACT

A retractable knife with single-edged blade comprises a handle of flat shape having a resilient member provided thereon; a blade hinged to handle; and an elongate protective member raised on the handle extended from one end to the opposite end along an edge thereof; wherein blade is engaged with protective member when blade is received onto handle such that blade is placed in a position away from reach of a user. By utilizing this, many advantages are offered such as user being not susceptible of hurt by the sharp blade when grasping or carrying knife, other objects being not susceptible of damage by the sharp blade when the objects are put together with knife, and the blade being not susceptible of wear due to a collision with the objects.

2 Claims, 4 Drawing Sheets

RETRACTABLE KNIFE WITH SINGLE-EDGED BLADE

BACKGROUND OF THE INVENTION

1. Field of the Invention

The present invention relates to a knife, and more particularly to a retractable knife with single-edged blade.

2. Description of Related Art

A conventional retractable knife 1 is shown in FIGS. 1–2. This retractable knife 1 is unsatisfactory for the following reasons:

It is inevitable of deformation or become loose after a long time use such that a gap 21 exists between the blade and handle 2 when blade is received in the handle 2. In other words, blade is suspended in the air which thus has a number of disadvantages such as a user being susceptible of hurt by the sharp blade when grasping, taking or carrying the retractable knife, other objects being susceptible of damage by the sharp blade when the objects are put together with the retractable knife, the blade being susceptible of wear due to a collision with the objects, and flat or sharp objects being capable of inserting into the gap 21 which in turn widens the gap 21, resulting in a much worse deformation and/or looseness.

Thus, it is desirable to provide a retractable knife with single-edged blade in order to overcome the above drawbacks of prior art.

SUMMARY OF THE INVENTION

It is an object of the present invention to provide a retractable knife with single-edged blade comprising a handle of generally flat oval shape; a blade hinged to a distal end of the handle; and a protective member provided on the handle generally extended from the distal end to a proximal end along an edge of the handle; wherein the blade is engaged with the protective member when the blade is received onto the handle such that the blade is placed in a position away from reach of a user. By utilizing this, a number of advantages are offered by the present invention such as a user being not susceptible of hurt by the sharp blade when grasping, taking or carrying the retractable knife, other objects being not susceptible of damage by the sharp blade when the objects are put together with the retractable knife, and the blade being not susceptible of wear due to a collision with the objects.

The above and other objects, features and advantages of the present invention will become apparent from the following detailed description taken with the accompanying drawings.

DETAILED DESCRIPTION OF THE PREFERRED EMBODIMENTS

Figure 1:
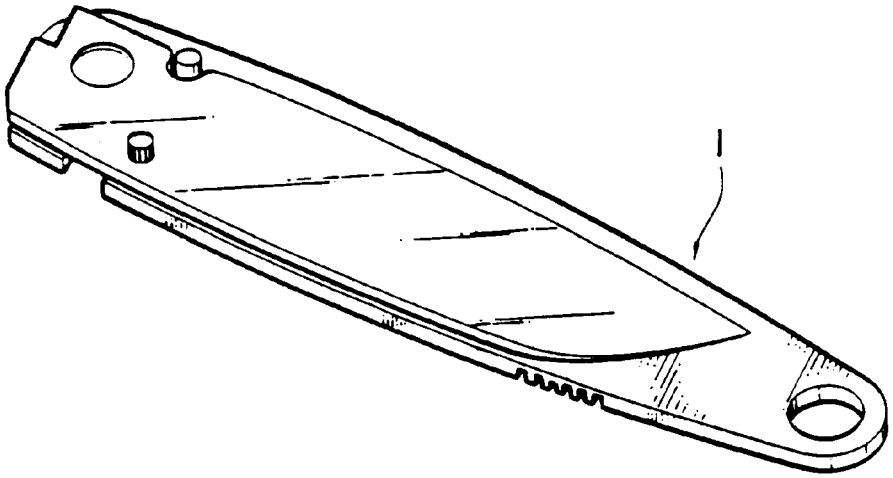
Fig. 1 Prior art
FIG. 1 is a perspective view of a prior art retractable knife.
Figure 2:
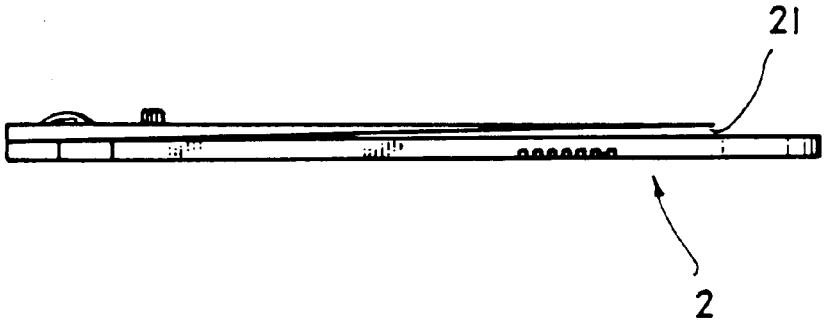
Fig. 2 Prior art
FIG. 2 is a sectional view of FIG. 1.
Figure 3:
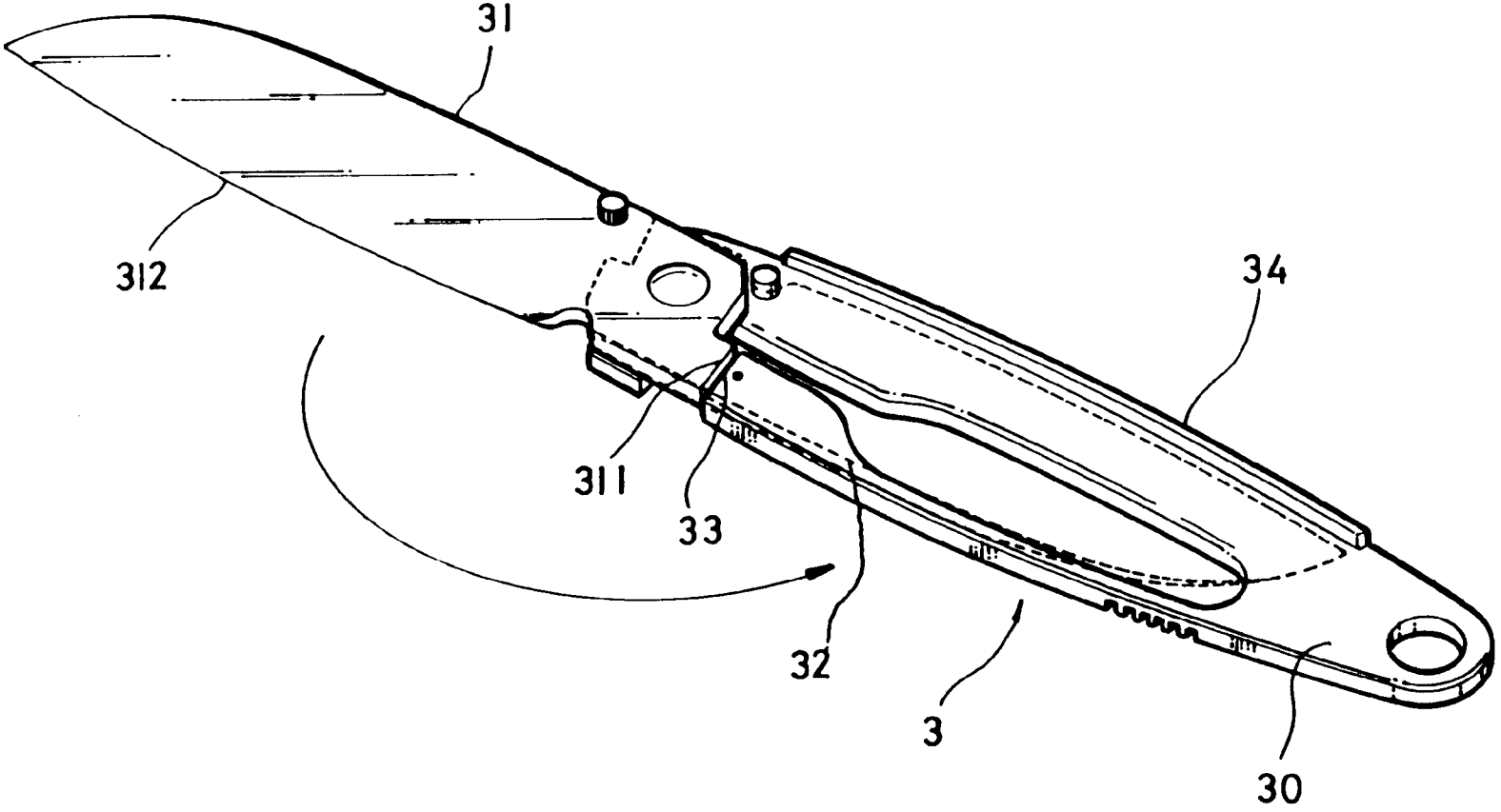
FIG. 3 is a perspective view of a retractable knife of a first embodiment of the present invention, illustrating an extended position.

Referring to FIG. 3, there is shown a retractable knife 3 with single-edged blade. The retractable knife 3 comprises a handle 30 of generally flat oval shape; a blade 31 hinged to a distal end of the handle 30; an aperture provided on the center portion of handle 30, a resilient member 32 provided on the lower portion of handle 30 having a shape of slightly curved upward at one end, a raised member 33 provided on an end of resilient member 32 being caught against an end 311 of the blade 31 when blade 31 is extended so as to affix the blade 31; and an elongate protective member 34 having a rectangular cross-section raised on the handle 30 generally extended from the distal end to a proximal end along an edge of the handle; wherein the protective member 34 is engaged with the sharp edge 312 of the blade 31 when the blade 31 is received onto the handle 30 such that the sharp edge 312 is placed in a position away from reach of a user. Therefore, a number of advantages are offered by the retractable knife with single-edged blade such as a user being not susceptible of hurt by the sharp edge 312 of blade 31 when grasping, taking or carrying the retractable knife 3, other objects being not susceptible of damage by the sharp edge 312 when the objects are put together with the retractable knife 3, and the sharp edge 312 of blade 31 being not susceptible of wear due to a collision with the objects. In brief, user and blade 31 both are protected.

Figure 4:
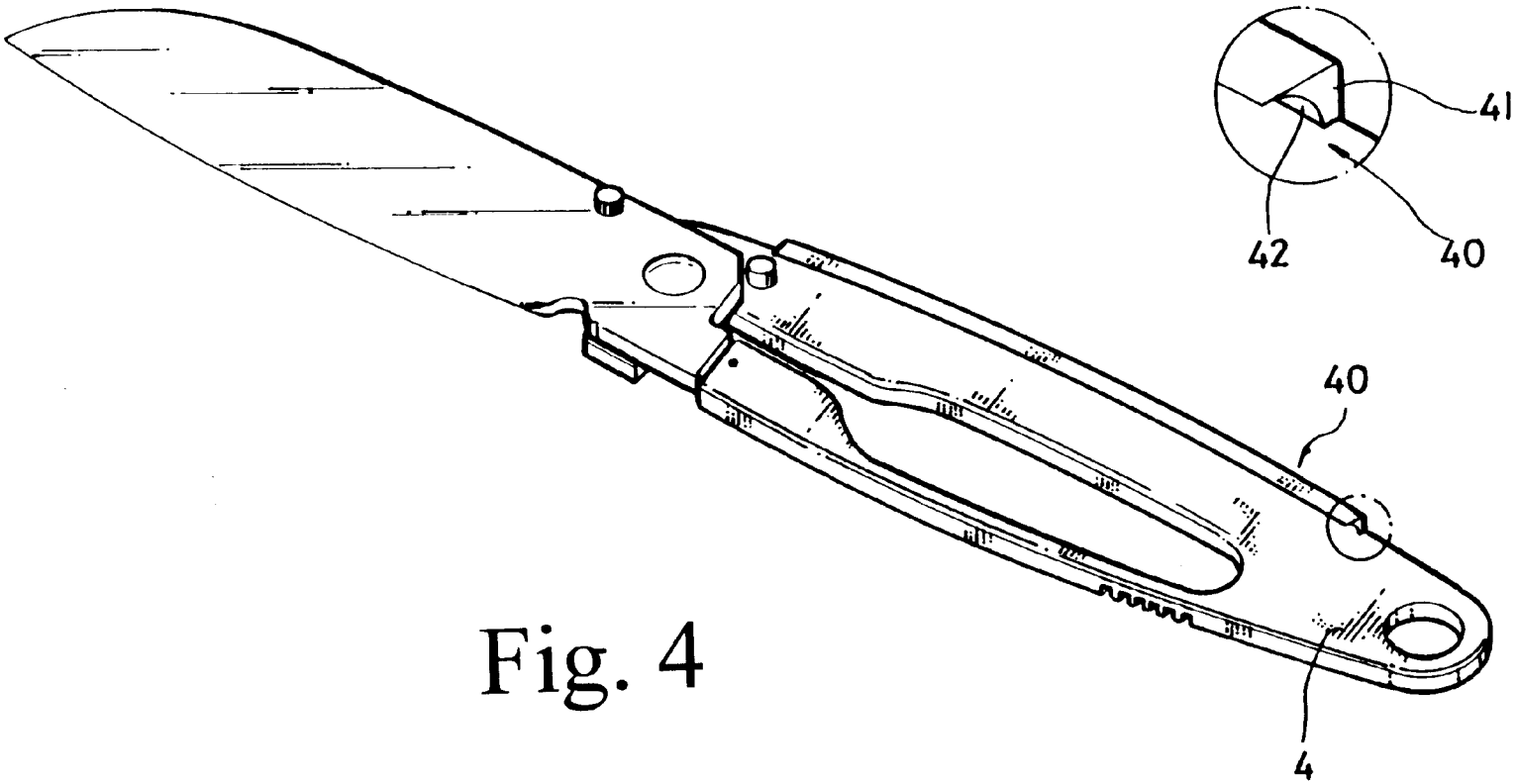
FIG. 4 is a perspective view of a retractable knife of a second embodiment of the present invention, illustrating an extended position.

FIG. 4 is a perspective view of a second embodiment of the present invention, illustrating an extended position wherein the protective member 40 has an arcuate inner surface to form a groove 42 between the protective member 40 and handle 4 for receiving the blade. In detail, the cross section of an end surface 41 of protective member 40 has a larger top with an inner edge curved toward a smaller bottom.

Figure 5:
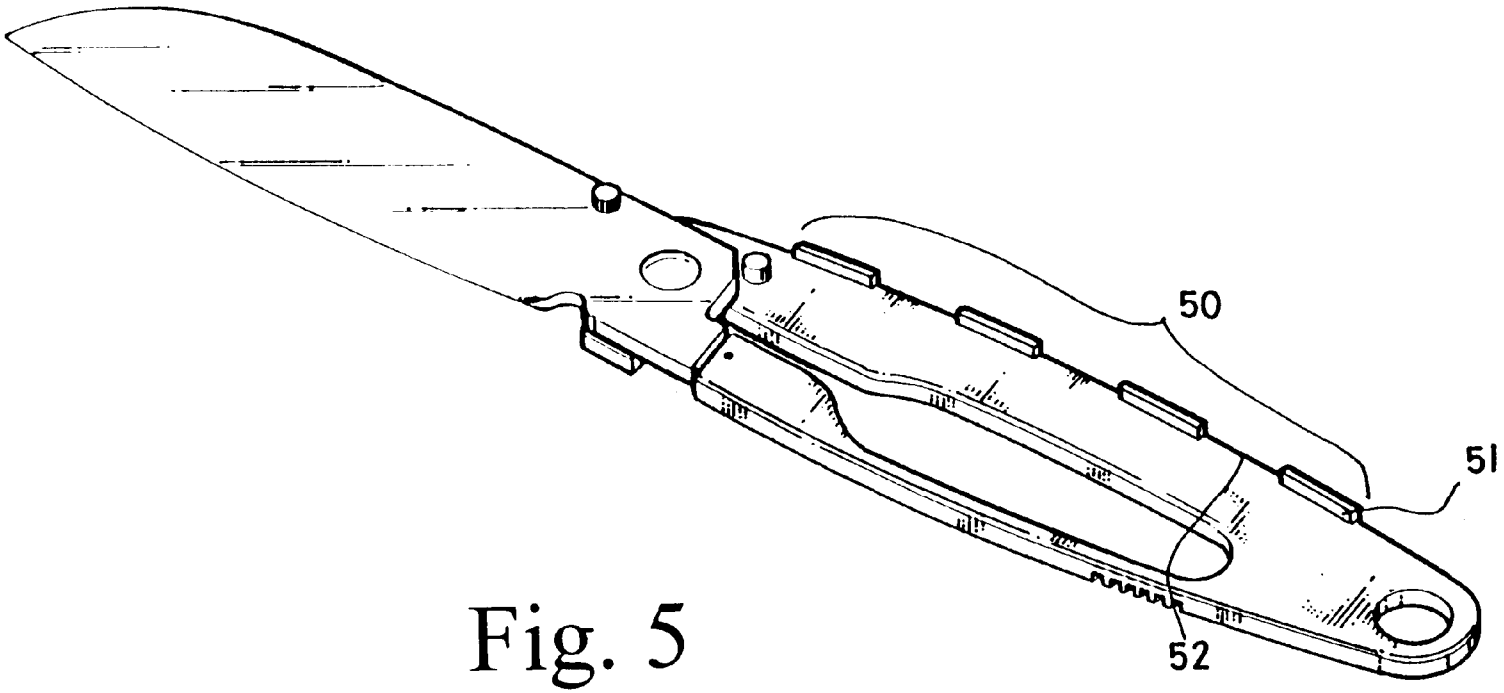
FIG. 5 is a perspective view of a retractable knife of a third embodiment of the present invention, illustrating an extended position.

FIG. 5 is a perspective view of a third embodiment of the present invention, illustrating an extended position wherein the protective member 50 is comprised of a number of risers 51 equally spaced apart along an edge of the handle. Preferably, a distance 52 between any two adjacent risers 51 is wide enough not to hurt the hand when user comfortably grasps the handle with blade set therein.

While the invention herein disclosed has been described by means of specific embodiments, numerous modifications and variations could be made thereto by those skilled in the art without departing from the scope of the invention set forth in the claims.

What is claimed is:

1. A retractable knife with single-edged blade comprising:

a handle of generally flat shape having a resilient member provided thereon;

a blade hinged to a distal end of the handle;

an elongate protective member having a generally rectangular cross-section raised on the handle and generally extended from the distal end to a proximal end of the handle along an edge thereof, the protective member has a larger top with an inner edge curved toward a smaller bottom thereof so as to form a groove between the protective member and the handle for receiving the blade, and wherein the blade is engaged with the protective member when the blade is received onto the handle such that the blade is placed in a position away from reach of a user.

2. A retractable knife with singe-edged blade comprising:

a handle of generally flat shape having a resilient member provided thereon;

a blade hinged to a distal end of the handle;

an elongate protective member having a generally rectangular cross-section raised on the handle and generally extended from the distal end to a proximal end of the handle along an edge thereof, the protective member comprising a plurality of risers equally spaced apart along the edge of the handle so as to cause a distance between adjacent risers wide enough not to hurt the user who grasps the handle with one end, and wherein the blade is engaged with the protective member when the blade is received onto the handle such that the blade is placed in a position away from reach of the user.

* * * * *